US005517223A

United States Patent [19]

Shin

[11] Patent Number: 5,517,223

[45] Date of Patent: May 14, 1996

[54] INKJET PRINTING METHOD AND APPARATUS

[75] Inventor: Kyu-cheol Shin, Kwacheon, Rep. of Korea

[73] Assignee: Samsung Electronics Co., Ltd., Kyungki-do, Rep. of Korea

[21] Appl. No.: 175,314

[22] Filed: Dec. 29, 1993

[30] Foreign Application Priority Data

Mar. 30, 1993 [KR] Rep. of Korea ..... 93-5123

[51] Int. Cl.[6] ..... B41J 2/06

[52] U.S. Cl. ..... 347/38; 347/48; 347/53; 347/54

[58] Field of Search ..... 347/38, 53, 54, 347/100, 48

[56] References Cited

U.S. PATENT DOCUMENTS

| | | | |
|---|---|---|---|
| 2,925,312 | 2/1960 | Hollmann | 347/53 X |
| 3,683,212 | 8/1972 | Zoltan | 347/68 X |
| 3,864,685 | 2/1975 | Fischbeck | 347/38 |
| 4,660,058 | 4/1987 | Cordery | 347/48 |
| 4,714,936 | 12/1987 | Helinski | 347/38 |
| 4,723,129 | 2/1988 | Endo et al. | 347/56 |

FOREIGN PATENT DOCUMENTS

| | | | |
|---|---|---|---|
| 55-11763 | 6/1980 | Japan | B23D 25/16 |
| 363118263 | 5/1988 | Japan | B41J 3/04 |
| 402178054 | 7/1990 | Japan | B41J 2/06 |

*Primary Examiner*—Joseph W. Hartary
*Attorney, Agent, or Firm*—Leydig, Voit & Mayer

[57] ABSTRACT

An inkjet printing method and apparatus in which an ejecting head is rotated to selectively eject ink by centrifugal force. The viscosity of ink is varied electrically or magnetically. The method and apparatus requires no additional heater, piezoelectric element or compressor, thereby simplifying the structure and reducing the production cost of the printer.

3 Claims, 2 Drawing Sheets

INKJET PRINTING METHOD AND APPARATUS

BACKGROUND OF THE INVENTION

The present invention relates to an inkjet printing method and apparatus and, more particularly, to an inkjet printing method and apparatus which uses centrifugal force of an ejection head and a viscosity change of ink during the rotation of the ejection head to eject a predetermined amount of the ink onto paper.

Conventional inkjet printing methods use a carriage moving method in which the ejection head reciprocates rectilinearly to discharge the ink onto paper or use a stationary operating method in which a fixed line head having a plurality of nozzles disposed in a row is used to discharge the ink onto paper from the plural nozzles. Such conventional inkjet printing methods employ various means to obtain an ink ejecting force.

For instance, in an inkjet printer using a bubble jet printing method, which is disclosed in U.S. Pat. No. 4,723,129, the ejecting force is obtained by the pressure of bubbles produced when the ink is heated. Such a printer needs an ink heating device that shortens the life of a head.

A Kyser-type inkjet printer, disclosed in U.S. Pat. No. 3,683,212 uses the deformation force of a piezoelectric element, which is created when a voltage is applied, as the ejecting force. In this printer, a stack of costly piezoelectric elements should be provided.

An inkjet printer disclosed in Japanese Laid-open Patent publication sho 55-11763 uses ink having variable electrical viscosity. This printer requires an additional compressor for producing the ejecting force.

As indicated above, in order to obtain the ejecting force of the ink, the conventional printers need an additional device, such as a heating device, piezoelectric element or compressor. Especially, the carriage mode printer needs a mechanical component such as a belt pulley for converting the rotation movement of a motor into rectilinear movement because the head must reciprocate rectilinearly. In the stationary line head, since the head must be larger than the width of a sheet of paper, the printer using a line head exhibits reduced reliability and is expensive.

SUMMARY OF THE INVENTION

To overcome such problems, an object of the present invention is to provide an inkjet printing method in which ink is discharged by an ejecting head's centrifugal force produced when the head rotates, without an additional device, such as a heating device, piezoelectric element or compressor.

Another object of the present invention is to provide an inkjet printing apparatus which is suitable for realizing inkjet printing.

To accomplish the first object, there is provided an inkjet printing method in which an ejecting head is rotated and a writing potential for forming an electric field is applied to a nozzle of the ejecting head according to a writing signal so as to vary the viscosity of ink having an electrically variable viscosity and thus to selectively discharge the ink by centrifugal force in a predetermined amount.

To accomplish the first object, there is provided another inkjet printing method in which an ejecting head is rotated and a writing potential for forming an electric field is applied to a nozzle of the ejecting head according to a writing signal so as to vary the viscosity of ink having a magnetically variable viscosity and thus to selectively discharge the ink by centrifugal force in a predetermined amount.

To accomplish the second object, there is provided an inkjet printing apparatus comprising: an ejecting head for ejecting ink having an electrically variable viscosity; a motor for rotating the ejecting head: an ejection controller for applying a writing potential for forming an electric field to a nozzle of the ejecting head according to a writing signal so as to vary the viscosity of the ink and thus to discharge the ink by centrifugal force in a predetermined amount; and a semicylindrical paper guide member centered on the central shaft of the motor for guiding paper.

To accomplish the second object, there is provided an inkjet printing apparatus comprising: an ejecting head for ejecting ink having a magnetically variable viscosity; a motor for rotating the ejecting head; an ejection controller for applying a writing potential for forming a magnetic field to a nozzle of the ejecting head according to a writing signal so as to vary the viscosity of the ink and thus to discharge the ink by centrifugal force in a predetermined amount; and a semicylindrical paper guide member centered on the central shaft of the motor for guiding paper.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
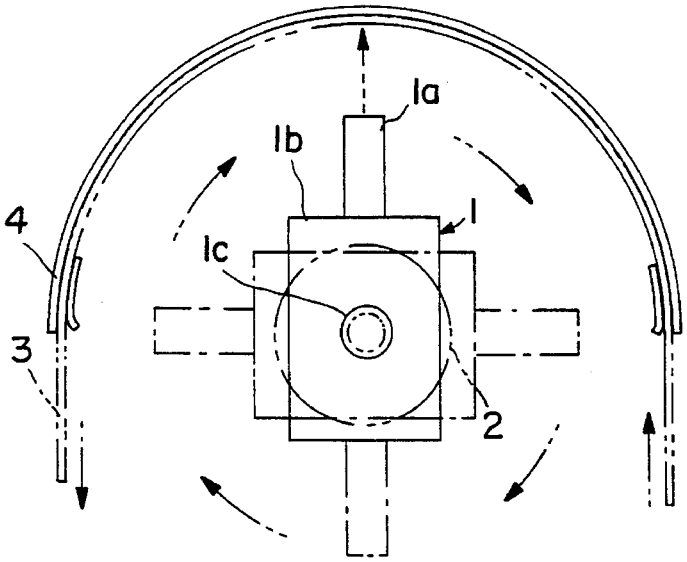
FIG. 1 is a schematic plan view of one embodiment of an inkjet printing apparatus of the present invention.
Figure 2:
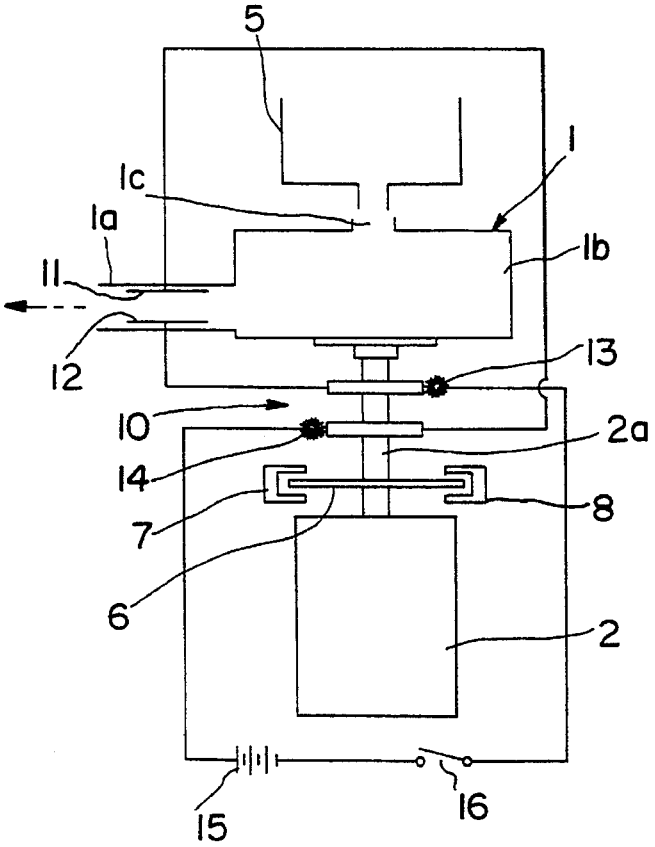
FIG. 2 is a schematic view of one embodiment of an inkjet printing apparatus of the present invention.

Referring to FIGS. 1 and 2, the inkjet printing apparatus of the present invention comprises an ejecting head 1 for discharging ink with an electrically variable viscosity, a motor 2 for rotating ejecting head 1, an ejection controller 10 for applying a writing potential 15, which forms an electric field, to a nozzle 1*a* ejecting head 1 according to a writing signal so as to vary the viscosity of the ink and thus to discharge a predetermined amount of the ink by centrifugal force, and a paper guide member 4 formed to be semicylindrical and centered about the rotation shaft 2*a* of motor 2 for guiding paper 3.

Ejecting head 1 has an ink receiver 1*b* for holding ink and nozzle 1*a* for ejecting the ink from ink receiver 1*b*. An ink supply hole 1*c* is formed on the top of ink receiver 1*b*. Directly above ink supply hole 1*c* is placed an ink reservoir 5 for automatically supplying a predetermined amount of ink. Here, since ink reservoir 5 supplies a predetermined amount of ink to ink receiver 1*b*, the rotation load of ejecting head 1 is minimized.

The electrically variable viscosity ink is varied in viscosity by an electric field. Such ink can be obtained by, for instance, mixing fine ink powder with an electrically variable viscosity fluid in which silica gel is dispersed in silicon oil. The obtained ink is continuously supplied to nozzle 1*a* connected to ink receiver 1*b* by capillary action and is thus ready to be ejected through nozzle 1*a*.

Ejection controller 10 consists of a pair of electrodes 11 and 12 opposingly placed on opposite sides of nozzle 1*a* of ejecting head 1, brushes 13 and 14 electrically connected to the pair of electrodes 11 and 12 and to which writing potential 15 is applied, and a switch 16 for switching writing potential 15 according to the writing signal.

A rotating disk 6 in which a multitude of light passing holes are radially formed, is provided on the rotation shaft 2*a* of motor 2. On the opposite sides of rotating disk 6 are an initial position detecting sensor 7 for detecting the initial writing position of ejecting head 1 and a rotation velocity detecting sensor 8 for detecting the rotation velocity of ejecting head 1.

Now, the operation of the inkjet printing apparatus of the present embodiment will be explained.

When motor 2 rotates ejecting head 1 clockwise at a normal velocity over time, rotating speed detecting sensor 8 detects the state of rotation and transmits a signal indicative of the normal-speed rotation to a write controller (not shown). Initial position detecting sensor 7 detects the initial writing position of ejecting head 1 and sends the detected signal to the write controller. The write controller converts image data into an electrical writing signal which is, in turn, sent to ejection controller 10. Ejection controller 10 switches writing potential 15 according to the writing signal so that the viscosity of the ink is varied and the ink is ejected by the centrifugal force. Thus, printing is carried out through this process.

More specifically, when ejecting head 1 rotates, the ink contained therein is influenced by centrifugal force. The centrifugal force enables the ink to be ejected in the direction of the arrow perpendicular to payer 3. When writing potential 15 is applied the pair of electrodes 11 and 12 placed inside nozzle 1*a* of ejecting head 1 and to brushes 13 and 14 electrically coupled to the pair of electrodes 11 and 12 by connecting switch 16, all of which are included in ejection controller 10, according to the writing signal, the ink having the electrically variable viscosity has the viscosity of a gel. This makes the viscosity of the ink greater than the centrifugal force and suppresses the ejection of ink.

Conversely, when writing potential 15 applied to the pair of electrodes 11 and 12 placed on the sides of nozzle 1*a* of ejecting head 1 is blocked using switch 16, the electrically variable viscosity ink has the viscosity of a liquid and the viscosity of the ink becomes smaller than the centrifugal force. Then, the centrifugal force eject the ink.

Printing is carried out by repeating this process according to the writing signal which is modulated with image data. During the printing, since paper 3 moves along the semicylindrical guide member 4 in the direction of the arrow tangent to the paper, the paper maintains a constant distance with respect to nozzle 1*a* of rotating ejecting head 1.

Another embodiment of the inkjet printing method and apparatus of the present invention will be described below in detail with reference to FIGS. 3 and 4.

Figure 3:
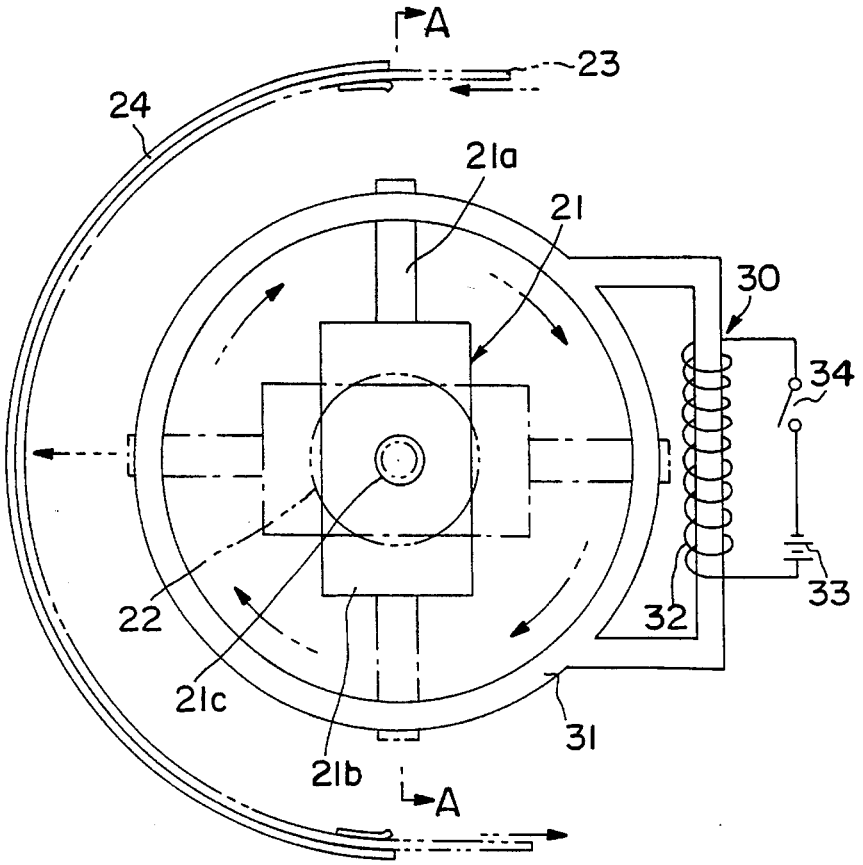
FIG. 3 is a schematic plan view of another embodiment of the inkjet printing apparatus of the present invention.
Figure 4:
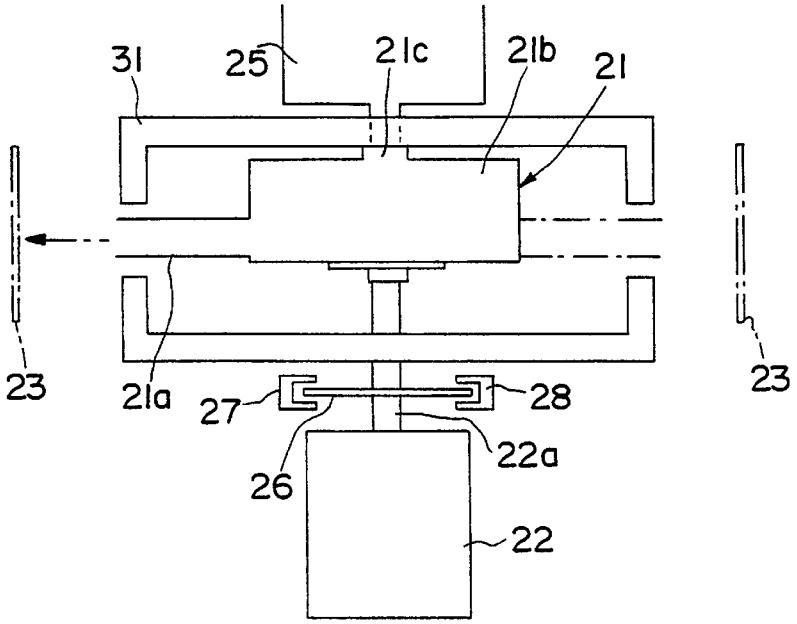
FIG. 4 is a schematic cross-sectional view of another embodiment of the inkjet printing apparatus of the present invention, taken along line A—A of FIG. 3.

The embodiment of the inkjet printing apparatus of the present invention in FIGS. 3 and 4 comprises an ejecting head 21 for ejecting ink having magnetically variable viscosity, a motor 22 for rotating ejecting head 21, an ejection controller 30 for applying a writing potential 33, which forms a magnetic field, to a nozzle 21*a* of ejecting head 21 according to a writing signal so as to vary the ink's viscosity and thus to discharge a predetermined amount of the ink by centrifugal force, and a paper guide member 24 that is semicylindrical and centered about the central shaft 22*a* of motor 22 and for guiding paper 23.

Similar to the first embodiment, ejecting head 21 has an ink receiver 21*b* for holding ink and nozzle 21*a* for ejecting the ink from ink receiver 21*b*. An ink supply hole 21*c* is formed on the top of ink receiver 21*b*. Directly above ink supply hole 21*c* is placed an ink reservoir 25 for automatically supplying ink in a predetermined amount. Here, since ink reservoir 25 supplies a predetermined amount of ink to ink receiver 21*b*, the rotation load of ejecting head 21 is reduced.

The magnetically variable viscosity ink has a viscosity varied by a magnetic field. The ink can be obtained by, for instance, mixing fine ink powder with a magnetically variable viscosity fluid in which ferrite powder is dissolved in paraffin oil. The obtained ink is continuously supplied to nozzle 21*a* connected to ink receiver 21*b* by capillary action and is thus ready to be ejected through nozzle 21*a*.

Ejection controller 30 includes a circular ferrite core 31 placed above and below nozzle 21*a* within the rotation track of nozzle 21*a* of ejecting head 21, while being spaced apart from nozzle 21*a* by a predetermined distance, a coil 32 provided on one side of circular ferrite core 31 and to which a writing potential 33 is applied, and a switch 34 for switching writing potential 33 according to the writing signal.

As in the first embodiment, a rotating disk 26 is provided on the rotation shaft 22*a* of motor 22. On the opposite sides of rotating disk 26 are an initial position detecting sensor 27 for detecting the initial writing position of ejecting head 21 and a rotation velocity detecting sensor 28 for detecting the rotation velocity of ejecting head 21.

The operation of the inkjet printing apparatus of this embodiment will be explained below.

When motor 22 rotates ejecting head 21 clockwise at a normal velocity over time, rotating speed detecting sensor 28 detects the state of rotation and transmits a signal indicative of the normal-speed rotation to a write controller (not shown). Initial position detecting sensor 27 detects the initial writing position of ejecting head 21 and sends the detected signal to the write controller. The write controller converts image data into an electrical writing signal which is, in turn, sent to ejection controller 30. Ejection controller 30 switches writing potential 33 according to the writing signal so that the viscosity of ink having the magnetically variable viscosity is varied and the ink is ejected by the centrifugal force. Thus, printing is carried out.

More specifically, when ejecting head 21 rotates, the ink contained therein is influenced by a centrifugal force. The centrifugal force enables the ink to be ejected in the direction of the arrow perpendicular to paper 3. When writing potential 33 is applied coil 32 wound around one side of circular ferrite core 31 provided above and below nozzle 21*a* of ejecting head 21 within the rotation track of the nozzle by connecting switch 34, all of which are included in ejection controller 10, according to the writing signal, a magnetic field is formed by circular ferrite core 31. The ink having the magnetically variable viscosity has the viscosity of a gel. This makes the viscosity of the ink greater than the centrifugal force and suppresses the ejection of ink.

Conversely, when writing potential 33 applied to coil 32 wound around circular ferrite core 31 placed above and below nozzle 21*a* of ejecting head 21 within the rotation track thereof is blocked using switch 34, the ink having the magnetically variable viscosity has the viscosity of a liquid and the viscosity of the ink becomes smaller than the centrifugal force. Then, the centrifugal force causes the ejection of ink.

Printing is carried out by repeating this process according to the writing signal which is modulated with image data. During the printing, since paper 23 moves along the semicylindrical guide member 24 in the direction of the arrow tangent to the paper, the paper maintains a constant distance with respect to nozzle 21*a* of rotating ejecting head 21.

As described above, since the present invention produces the ejecting force of ink using the centrifugal force of an ejecting head while rotating the head, the printing apparatus is simplified in structure and reduced in cost, as compared with the conventional printer using a heating device, piezoelectric element or compressor to obtain the ink ejecting force.

What is claimed is:

1. An inkjet printing apparatus comprising:

an ejecting head having a nozzle for ejecting ink having a magnetically variable viscosity;

a motor having a rotating shaft for rotating said ejecting head;

an ejection controller including a circular magnetic core spaced from and located on opposite sides of said nozzle of said ejecting head within a rotation track of said nozzle, a coil provided on said circular magnetic core to which a writing potential is applied to vary the viscosity of the ink for selectively discharging a predetermined amount of the ink through said nozzle with centrifugal force produced by rotation of said ejecting head, and switching means for switching the writing potential according to a writing signal; and a semicylindrical paper guide member centered about the shaft of said motor for guiding paper.

2. The inkjet printing apparatus as claimed in claim 1, comprising:

an initial position detecting sensor for detecting an initial printing position of said ejecting head and a rotation velocity detecting sensor for detecting rotation velocity of said ejecting head.

3. The inkjet printing apparatus as claimed in claim 1 wherein said ejecting head includes an ink supply hole and including an ink container placed directly above said ink supply hole for automatically supplying ink in a predetermined amount to said ejecting head.

* * * * *